United States Patent [19]

Wolfe et al.

[11] 4,325,000

[45] Apr. 13, 1982

[54] LOW WORK FUNCTION CATHODE

[75] Inventors: John E. Wolfe, Julian, Calif.; Lynwood W. Swanson, McMinnville, Oreg.

[73] Assignee: Burroughs Corporation, Detroit, Mich.

[21] Appl. No.: 145,042

[22] Filed: Apr. 20, 1980

[51] Int. Cl.[3] ..... H01J 1/16; H01J 19/10

[52] U.S. Cl. ..... 313/336; 29/25.17; 313/346 R; 427/77; 252/515

[58] Field of Search ..... 313/336, 337, 346; 29/25.17; 427/77, 78; 252/515

[56] References Cited

U.S. PATENT DOCUMENTS

| | | | |
|---|---|---|---|
| 3,374,386 | 3/1968 | Charbonnier et al. | 313/336 X |
| 3,425,111 | 2/1969 | Denison, Jr. | 313/346 |
| 3,631,291 | 12/1971 | Favreau | 313/336 |
| 3,678,325 | 7/1972 | Nishida et al. | 313/336 |
| 3,947,716 | 3/1976 | Fraser, Jr. et al. | 313/336 |

FOREIGN PATENT DOCUMENTS

| | | | |
|---|---|---|---|
| 381115 | 7/1973 | U.S.S.R. | 313/336 |

*Primary Examiner*—Saxfield Chatmon, Jr.
*Attorney, Agent, or Firm*—Charles J. Fassbender; Kevin R. Peterson

[57] ABSTRACT

Disclosed is an electron-beam cathode which emits electrons with a low work function over a relatively wide range of temperature and pressure. The cathode is comprised of single crystal tungsten having zirconium and oxygen dopant atoms within the bulk thereof. This cathode is formed by the steps of attaching zirconium to a portion of the surface of single crystal tungsten, and heating the tungsten with the zirconium attached thereto in an atmosphere of oxygen to diffuse the zirconium and the oxygen into the bulk of the tungsten.

9 Claims, 5 Drawing Figures

LOW WORK FUNCTION CATHODE

BACKGROUND OF THE INVENTION

This invention relates to the subject of electronic emission from the surface of a metal, i.e.—the liberation of electrons from the metal's surface; and more particularly, it relates to the fabrication of cathodes for producing electronic emission. Such cathodes are used, for example, in all vacuum tubes and electron-beam devices.

Basically, in any metal, there exists a large number of valence electrons which are relatively free to move within the bulk of the metal. But at the metal's surface, there is a potential barrier which tends to prevent electrons from leaving the metal. Thus, before an electron can be emitted from a metal, it must possess sufficient energy to overcome the potential barrier. That energy in electron-volts is called the barrier potential.

At a temperature of absolute zero, no electrons have sufficient energy to escape from the metal's bulk; and the largest energy which any electron has is called the Fermi level. Therefore, for electronic emission to occur, an electron must gain an amount of energy which is at least equal to the difference between the barrier potential and the Fermi level. That energy difference is called the work function, and it varies from metal to metal.

Low work function cathodes are, of course, desirable since a lower work function yields a larger current for any given operating temperature, and electric field. And in the prior art, one cathode having a work function of only 2.7 ev is described in U.S. Pat. No. 3,814,975 issued June 4, 1974 to Wolfe et al. That cathode is also illustrated herein in FIG. 1 as indicated by reference numeral 10.

Cathode 10 is comprised of a single crystal tungsten needle 11 whose axis is oriented in the (100) direction, having a ring of zirconium 12 attached to it. (Col. 9, lines 48–52 of U.S. Pat. No. 3,814,975). Suitably, needle 11 is about 30 mil high, about 5 mils across the base, and its tip is rounded with a radius of about 1 um (col. 8, lines 63–68 and col. 9, lines 1–5 of U.S. Pat. No. 3,814,975). Also, a hairpin-shaped filament 13 is attached to needle 11, to provide a means for heating the needle. (Col. 4, lines 48–49 of U.S. Pat. No. 3,814,975).

In operation, the zirconium migrates from the ring 12 over the surface of needle 11. (Col. 9, lines 52–53 of U.S. Pat. No. 3,814,975). This surface migration is indicated by the arrow 14 in FIG. 1. As a result of this surface migration, the zirconium covers the tip of needle 11. There, the zirconium together with oxygen atoms in the residual gas 15 of the vacuum that surrounds needle 11 cause the needle's work function to be reduced from 4.5 ev for pure tungsten to 2.7 ev. (Col. 9, lines 54–60 of U.S. Pat. No. 3,814,975).

An undesirable characteristic, however, of the above described cathode is that its 2.7 ev work function is dependent on the needle's temperature, and on the pressure of the surrounding residual gas 15. (Col. 10, lines 3–6 of U.S. Pat. No. 3,814,975). This characteristic is illustrated herein in FIG. 2. There, beam current $I_b$ along the needle's axis 16 is plotted on the vertical axis, pressure P of the residual gas 15 is plotted on the horizontal axis, and temperature is indicated as $T_1$, $T_2$, and $T_3$. Curves 21, 22, and 23 respectively show how $I_b$ and P are interrelated for temperatures $T_1$, $T_2$, and $T_3$ where $T_3 > T_2 > T_1$.

The important point here is that given a specific temperature, there is only one optimum operating pressure at which the beam current $I_b$ will peak. At that pressure, the cathode's work function is indeed 2.7 ev. But as the operating conditions vary from optimum, the needle's work function increases, which causes the beam current $I_b$ to drop.

Accordingly, a primary object of the invention is to provide an improved electron-beam cathode.

Another object of the invention is to provide an electron-beam cathode having a work function of 2.7 ev which is substantially insensitive to temperature and pressure fluctuations.

Still another object is to provide a method of making an electron-beam cathode which meets the above objectives.

BRIEF SUMMARY OF THE INVENTION

These and other objectives are accomplished in accordance with the invention by an electron-beam cathode which emits electrons with a low work function over a relatively wide range of temperature and pressure. The cathode is comprised of single crystal tungsten having zirconium and oxygen dopant atoms within the bulk thereof.

This cathode is formed by the steps of attaching zirconium to a portion of the surface of single crystal tungsten, and heating the tungsten with the zirconium attached thereto in an atmosphere of oxygen to diffuse the zirconium and the oxygen into the bulk of the tungsten.

Subsequently, in operation, the single crystal tungsten having dopant atoms of zirconium and oxygen is heated in an oxygen free gas. There, the zirconium diffuses to the tungsten's surface where it forms a monolayer which lowers the cathode's work function.

BRIEF DESCRIPTION OF THE DRAWINGS

Various features and advantages of the invention will best be understood by reference to the following detailed description and accompanying drawings wherein.

DETAILED DESCRIPTION

Figure 1:
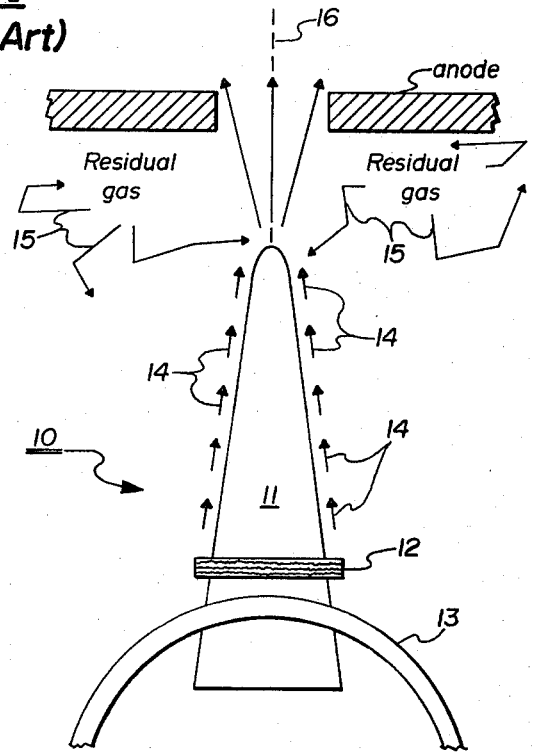
Fig. 1 (Prior Art)
FIG. 1 illustrates the structure and operation of an electron-beam cathode in accordance with the prior art.
Figure 3:
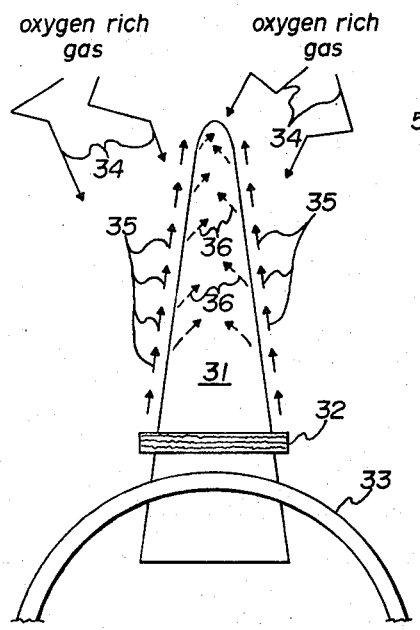
FIG. 3 illustrates a process of fabricating an electron-beam cathode in accordance with the present invention.

Referring now to FIG. 3, a method of making an electron-beam cathode which emits electrons with a low work function over a relatively wide range of temperature and pressure will be described. This method begins by providing a piece of single crystal tungsten 31, and attaching zirconium 32 to a portion of the surface thereof. Suitably, the tungsten crystal 31 is needle-shaped with an axis which is (100) oriented; and the zirconium 32 is attached to the needle's base just as was done in the prior art that was described in conjunction with FIG. 1. A filament 33 is also attached to the zirconium crystal 31 as a means for heating it.

Thereafter, components 31, 32, and 33 are heated in an atmosphere of an oxygen rich gas 34. Suitably, the temperature is 1700° K.–1900° K.; and the partial pressure of the oxygen is at least fifty times the partial pressure of any other gases contained in the surrounding atmosphere. For example, an oxygen pressure of $10^{-6}$ Torr, in a vacuum of $10^{-8}$ Torr is in accordance with the above.

As a result of the above heating, the zirconium 32 migrates along the surface of the crystal 31 as indicated via reference numeral 35. But in addition, as a result of the oxygen rich gas 34 being present, the zirconium diffuses into the bulk of the tungsten. This bulk diffusion is indicated by reference numerals 36.

The fact that oxygen makes zirconium soluble in solid tungsten is herein made use of to create a single crystal cathode having host atoms of tungsten and dopant atoms of zirconium and oxygen. The amount of zirconium which is diffused into the tungsten can be very high. For example, if a 4 mil wide, 1 mil thick ring of zirconium is provided around a 30 mil high tungsten needle which is 5 mil wide at its base, and if all of the zirconium is diffused into the tungsten needle, then the resulting impurity concentration would be about 10%. Typically, a 4 mil wide, 1 mil thick ring of zirconium will completely dissolve within about one day of oxygen processing.

Figure 4:
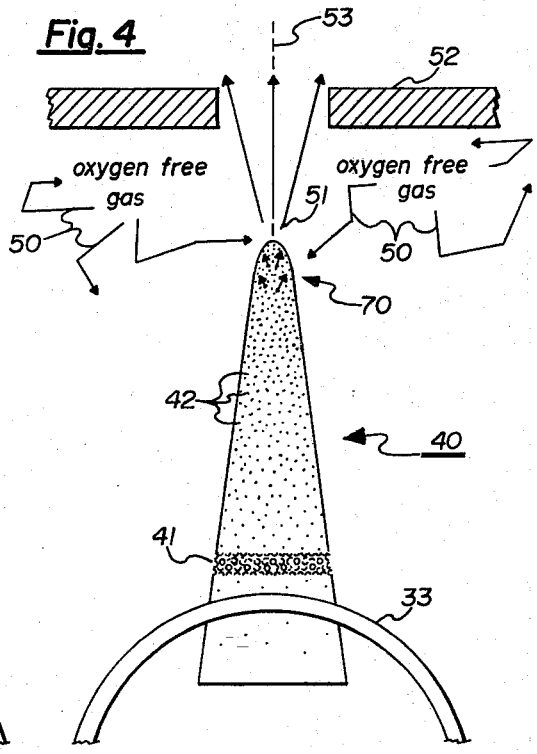
FIG. 4 illustrates the structure and operation of an electron-beam cathode which is constructed by the FIG. 3 process.

After the cathode of FIG. 3 has been processed as described above, its appearance is as indicated by reference numeral 40 in FIG. 4. There, reference numeral 41 indicates a mottled ring-shaped surface which remains after all the zirconium ring 32 is dissolved. Also, the "dots" 42 schematically represent the zirconium atoms which are inside the tungsten.

During operation, cathode 40 is placed in an oxygen free gas 50. Thereafter, thermionic field emission of electrons from the cathode's tip 51 is initiated by applying a voltage to an anode 52 and by passing a heat producing current through filament 33. In this mode of operation, cathode 40 emits electrons with a substantially constant work function of 2.7 ev, independent of variations in temperature and pressure.

Figure 2:
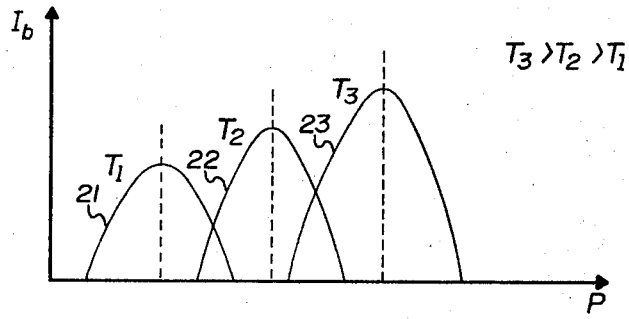
Fig. 2 (Prior Art)
FIG. 2 is a set of curves illustrating the dependence of beam current on temperature and pressure in the cathode of FIG. 1.
Figure 5:
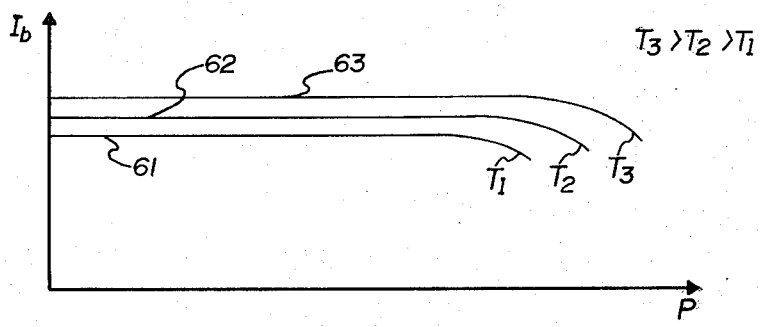
FIG. 5 is a set of curves illustrating the independence of beam current as a function of temperature and pressure in the cathode of FIG. 4.

This insensitivity to temperature and pressure is illustrated in FIG. 5. There, the beam current $I_b$ along the needle's axis 53 is plotted as a function of temperature and pressure. In particular, curves 61, 62, and 63 respectively show beam current for variable pressure and fixed temperatures $T_1$, $T_2$, and $T_3$ where $T_3 > T_2 > T_1$. The key points here are that curves 61, 62, and 63 are relatively flat (whereas the corresponding prior art curves of FIG. 2 are not; and that the magnitude of the beam current along the flat portion of curves 61, 62, and 63 respectively correspond to the magnitude of the peak beam current in parabolic curves 20, 21, and 22.

An experimentally verified explanation for this result is as follows. In the oxygen free gas 50, the zirconium atoms diffuse from the bulk of cathode 40 back to the surface. Reference numeral 70 in FIG. 4 indicates this diffusion at the cathode's tip 51. As a result of this diffusion, a single atomic layer of zirconium forms on tip 51. This atomic single layer is exactly what is needed to produce the desired 2.7 ev work function.

By comparison, when no zirconium is on the tip, then the cathode has a work function of pure tungsten—which is 4.5 ev; and when multiple atomic layers of zirconium are on the tip, then the cathode has a work function of pure zirconium—which is 3.3 ev. In the prior art cathode of FIG. 1, the pressure and temperature operated together to vary the number of atomic layer of zirconium on the cathode tip because the zirconium flowed to the tip over the cathode's surface. But in the present invention, zirconium is supplied to the cathode's tip from within the cathode's bulk. And when zirconium is supplied in this manner, the work function is 2.7 ev, which suggests that only one atomic layer builds up on the tip for a wide range of temperature and pressure.

One preferred embodiment and steps for carrying out the invention have now been described in detail. In addition, however, various changes and modifications can be made to these details without departing from the nature and spirit of the invention. Therefore, it is to be understood that the invention is not limited to said details but is defined by the appended claims.

What is claimed is:

1. A method of making an electron-beam cathode having a tip which emits electrons with a low work function over a relatively wide range of temperature and pressure in an oxygen free atmosphere; said method including the steps of:

attaching zirconium in multiple atomic layers to a portion of the surface of single crystal tungsten; and heating said single crystal tungsten with said zirconium attached thereto in an oxygen rich atmosphere to diffuse said zirconium and said oxygen into the bulk of said tungsten;

said bulk of said tungsten with said zirconium and said oxygen diffused therein forming said low work function cathode, which operates by dispensing a single atomic layer of said zirconium and oxygen from said bulk to said tip when heated in said oxygen free atmosphere.

2. A method according to claim 1 wherein said heating occurs for approximately twenty hours at a temperature of 1700° K.–1900° K.

3. A method according to claim 1 wherein said atmosphere of oxygen has a partial pressure of at least fifty times the partial pressure of any other gases contain therein.

4. A method according to claim 1 wherein said zirconium is at least 10% by volume of said tungsten.

5. A method according to claim 1 wherein said single crystal tungsten is needle-shaped.

6. An electron-beam cathode having a tip which emits electrons with a low work function over a relatively wide range of temperature and pressure in an oxygen free atmosphere; said cathode being formed by the steps of:

attaching zirconium in multiple atomic layers to a portion of the surface of single crystal tungsten; and heating said single crystal tungsten with said zirconium attached thereto in an oxygen rich atmosphere to diffuse said zirconium and said oxygen into the bulk of said tungsten;

said bulk of said tungsten with said zirconium and said oxygen diffused therein forming said low work function cathode, which operates by dispensing a single atomic layer of said zirconium and oxygen from said bulk to said tip when heated in said oxygen free atmosphere.

7. An electron-beam cathode which emits electrons with a low work function over a relatively wide range of temperature and pressure; said cathode being comprised of single crystal tungsten with zirconium and oxygen dopant atoms within the bulk of said tungsten; said single crystal tungsten also including a tip to which a single atomic layer of said zirconium and oxygen dopant atoms diffuse from said bulk when said cathode is heated in oxygen free atmosphere.

8. A cathode according to claim 7 wherein said zirconium is at least 10% by volume of said tungsten.

9. A cathode according to claim 7 wherein said single crystal tungsten is needle-shaped.

* * * * *